US006173850B1

(12) United States Patent
Scheetz, Jr. et al.

(10) Patent No.: US 6,173,850 B1
(45) Date of Patent: Jan. 16, 2001

(54) ERGONOMIC BABY BOTTLE CONSTRUCTION

(76) Inventors: Gordon Lee Scheetz, Jr.; Gina E. Scheetz, both of 4013 Green's Way Cir., Collegeville, PA (US) 19426

( * ) Notice: Under 35 U.S.C. 154(b), the term of this patent shall be extended for 0 days.

(21) Appl. No.: 09/390,094

(22) Filed: Sep. 3, 1999

(51) Int. Cl.[7] ..... A61J 9/00

(52) U.S. Cl. ..... 215/11.1; 215/384; 215/398; 220/771

(58) Field of Search ..... 215/11.1, 384, 215/398; 220/771; D9/543; D24/197

(56) References Cited

U.S. PATENT DOCUMENTS

| | | | | |
|---|---|---|---|---|
| D. 191,770 | * | 11/1961 | Schacher et al. | D9/543 |
| D. 340,217 | * | 10/1993 | Delage et al. | D9/543 X |
| D. 413,808 | * | 9/1999 | Bolliger et al. | D9/543 |
| D. 429,159 | * | 8/2000 | Feen | D9/543 X |
| 1,610,136 | * | 12/1926 | Kelty | 215/11.1 |
| 3,145,867 | * | 8/1964 | Roberts et al. | 215/11.1 |
| 4,676,387 | | 6/1987 | Stephenson et al. | 215/11 R |
| 5,044,509 | * | 9/1991 | Petrosky et al. | 215/11.1 X |
| 5,263,599 | | 11/1993 | Sklar | 215/11.1 |
| 5,316,160 | | 5/1994 | Cautereels | 215/11.1 |
| 5,531,338 | | 7/1996 | Sklar | 215/11.1 |
| 5,807,156 | | 9/1998 | Owen | 446/77 |
| 5,927,533 | * | 7/1999 | Payne et al. | 220/771 X |
| 6,073,788 | * | 6/2000 | Stroud | 215/11.1 |

* cited by examiner

*Primary Examiner*—Sue A. Weaver
(74) *Attorney, Agent, or Firm*—Henderson & Sturm LLP

(57) ABSTRACT

An ergonomic baby bottle construction 10 including a baby bottle member 20 having a lower generally cylindrical base portion 21 and an upper bent neck portion 30 which is disposed at an acute angle relative to the base portion 21. The rear surface of both the upper end of the base portion 21 and the bent neck portion 30 are provided with a plurality of finger grooves 40 which extend towards the front surface of the bent neck portion 30 such that the base portion 21 of the bottle member 20 will be disposed in a vertical orientation when the bottle member 20 is disposed in the feeding orientation.

8 Claims, 1 Drawing Sheet

ERGONOMIC BABY BOTTLE CONSTRUCTION

BACKGROUND OF THE INVENTION

1. Field of the Invention

The present invention relates to the field of baby bottle constructions in general, and more particularly to an ergonomically designed baby bottle that will not only reduce wrist fatigue, but also allow the parent to have a quick visual reference as to the amount of formula consumed by the infant.

2. Description of Related Art

As can be seen by reference to the following U.S. Pat. Nos. 4,676,387; 5,263,599; 5,316,160; 5,531,338; and 5,807,156, the prior art is replete with myriad and diverse baby bottle constructions.

While all of the aforementioned prior art constructions are more than adequate for the basic purpose and function for which they have been specifically designed, they are uniformly deficient with respect to their failure to provide a simple, efficient, and practical baby bottle construction having an angled neck provided with a series of ergonomically designed grooves that will not only enhance a care giver's grasp of the bottle, but will also force the user's grasp to assume an ergonomically relaxed position while tending to the infant's needs.

Given the recent increase in multiple birth events attributable to both fertility drugs and in vitro techniques, a problem has arisen for those parents who are faced with feeding multiple newborns at regular intervals.

As a consequence of the foregoing situation, there has suddenly existed a longstanding need for a new and improved ergonomically designed baby bottle construction that will substantially reduce the wrist fatigue that is experienced by those parents who spend hours a day coping with multiple infant feedings, and the provision of such a construction is a stated objective of the present invention.

BRIEF SUMMARY OF THE INVENTION

Briefly stated, the ergonomic baby bottle construction that forms the basis of the present invention comprises in general, a bottle member having a lower generally cylindrical base portion which transitions into an upper bent neck portion disposed at an acute angle relative to the longitudinal axis of the lower base portion.

As will be explained in greater detail further on in the specification, the upper and lower portions of the bottle member have an elongated rear surface and a shortened front surface. A plurality of finger grooves having tapered ends are disposed on the rear surfaces of the upper end of the base portion and the bent neck portion and extend around the sides of the bent neck portion and converge towards the front surface of the bent neck portion of the bottle member.

In addition, the finger grooves are separated from one another by a plurality of raised ridges to improve the user's grasp on the bottle member and the finger grooves are also disposed at an acute angle relative to the longitudinal axis of the lower base portion such that when the user positions the bottle member in the feeding position, the base portion will be disposed in a vertically upright position to lessen the stress on the user's wrist.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
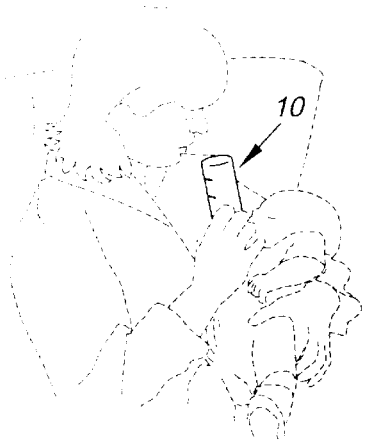
FIG. 1 is a perspective view of the ergonomic baby bottle construction of this invention in use.

As can be seen by reference to the drawings, and in particular to FIG. 1, the ergonomic baby bottle construction that forms the basis of the present invention is designated generally by the reference number 10. The construction 10 comprises in general, a bottle member 20 having a bent neck portion 30 which is provided with a plurality of tapered end finger grooves 40 whose purpose and function will be described in greater detail further on in the specification.

Figure 2:
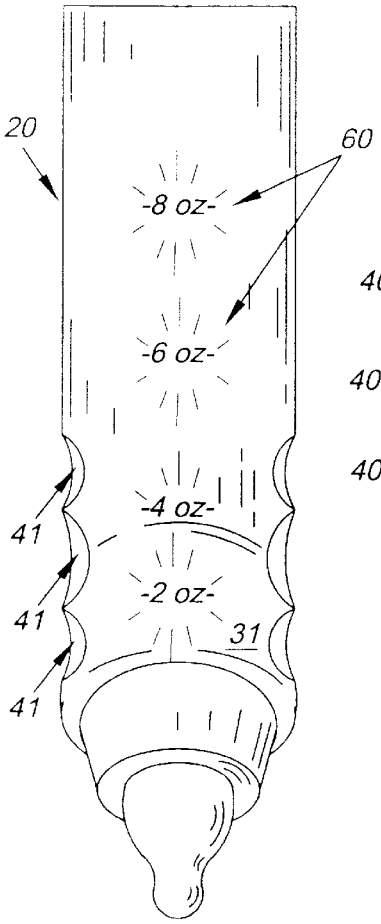
FIG. 2 is an inverted front plan view of the baby bottle construction.
Figure 3:
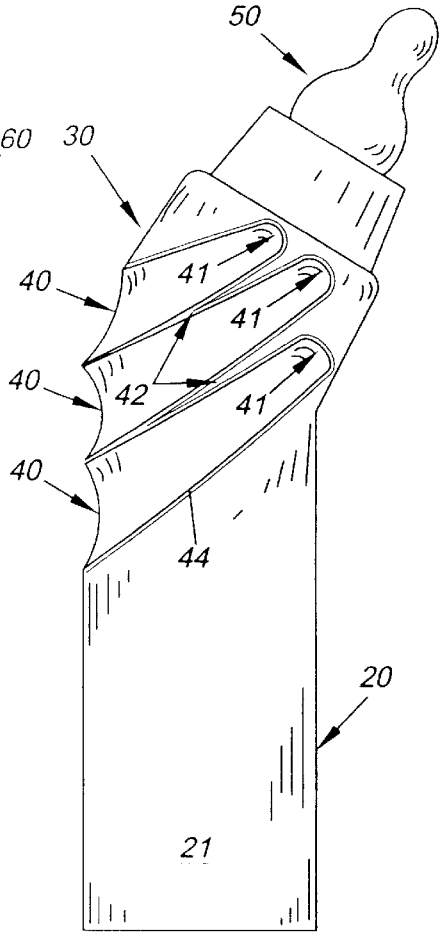
FIG. 3 is a side plan view of the baby bottle construction in the upright position.
Figure 4:
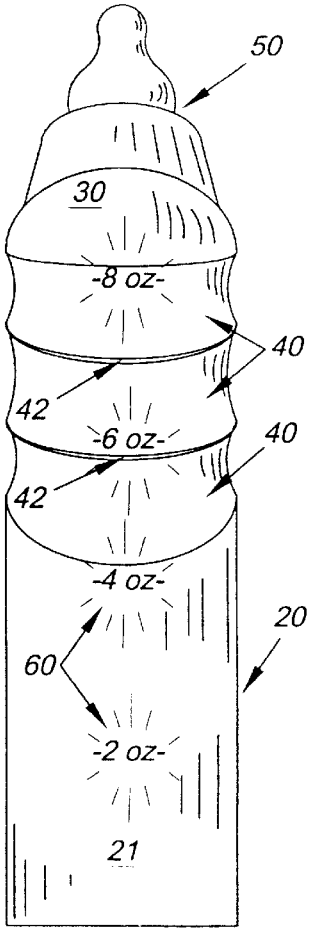
FIG. 4 is a rear plan view of the baby bottle construction in the upright position.

As shown in FIGS. 2 through 4, the bottle member 20 has a cylindrical lower base portion 21 and a bent neck upper portion 30 which is disposed at an acute angle relative to the longitudinal axis of the base portion 21. The angular orientation of the upper portion 30 to the lower portion 20 is disposed at an angle of approximately 30°.

As can also be seen by reference to FIGS. 2 through 4, the rear surface of the bent neck portion 30 of the bottle member 20 and the rear surface of the upper end of the base portion 21 of the bottle member 20 are provided with a plurality of finger grooves 40 which extend from the rear surface towards the front surface of the bottle member 20. Each of the finger grooves 40 have tapered ends 41 which converge towards the front surface of bent neck portion 30 of the bottle member 20 and the sides of the finger grooves 40 are disposed at an angle of approximately 45° relative to the longitudinal axis of the lower portion of the bottle member 20.

In addition, the external periphery of the finger grooves 40 are surrounded by a non-slip material 44 such as rubber or the like to facilitate the user's grasp on the bottle member 20.

As a consequence of the foregoing structural arrangement when a user inverts the bottle member 20 as depicted in FIGS. 1 and 2 by grasping the finger grooves 40 and inserts the nipple bearing cap 50 that is connected to the bent neck portion 30 of the bottle member 20 into the infant's mouth the generally cylindrical base portion 21 will be disposed in a vertically upright position which lessens the strain on the hand that is supporting the bottle member.

It should also be appreciated at this juncture that given the fact that the upper intermediate, and lower finger grooves 40 extend on both sides of the bottle member 20 this construction is equally adaptable to both right handed and left handed usage and the presence of the raised ridges 42 on the opposite sides of the intermediate finger groove 40 enhances the user's grasp of the bottle member 20 regardless of which hand is employed by the parent during the feeding process.

Turning now to FIGS. 2 and 4, it can be seen that both the front and rear surfaces of the bottle member 20 are provided with two sets of luminous indicia 60, 60' wherein one set of indicia 60 registers the remaining fluid content of the bottle member 20 in the inverted feeding position and the other set of luminous indicia indicates the fluid content in the upright fluid filling position so that those visual indicia will be readily available to the parent during night time feedings and the like.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

We claim:

1. An ergonomic baby bottle construction comprising:

a baby bottle member having a lower generally cylindrical base portion and an upper bent neck portion disposed at an acute angle relative to the base portion wherein both the base portion and the bent neck portions have front and rear surfaces; and a plurality of finger grooves having tapered ends and extending from the rear surface of the bent neck portion and the upper end of the base portion of the bottle member towards the front surface of the bent neck portion of the bottle member.

2. The construction as in claim 1 wherein the plurality of finger grooves include an upper finger groove, an intermediate finger groove, and a lower finger groove.

3. The construction as in claim 2 wherein the raised ridges separate the intermediate finger groove from the upper and lower finger grooves.

4. The construction as in claim 2 wherein the periphery of the finger grooves are surrounded by a non-slip material.

5. The construction as in claim 1 wherein the bent neck portion of the bottle member is disposed at an angle of approximately 30° relative to the longitudinal axis of the lower base portion of the bottle member.

6. The construction as in claim 5 wherein the plurality of finger grooves are disposed at an angle of approximately 45° relative to the longitudinal axis of the lower base portion of the bottle member.

7. The construction as in claim 6 wherein the front and rear surfaces of the bottle member are provided with two sets of luminous indicia.

8. The construction as in claim 7 wherein each set of luminous indicia is the inverse of the other set of luminous indicia.

* * * * *